US008689454B2

(12) United States Patent
Pulkrabek et al.

(10) Patent No.: US 8,689,454 B2
(45) Date of Patent: Apr. 8, 2014

(54) MULTI-AXIS BOW SIGHT

(75) Inventors: Larry Pulkrabek, Osceola, IA (US); Jay Engstrom, Port Wing, WI (US); Aaron Pellett, Alborn, MN (US); Matthew Haas, Duluth, MN (US)

(73) Assignee: Field Logic, Inc., Superior, WI (US)

( * ) Notice: Subject to any disclaimer, the term of this patent is extended or adjusted under 35 U.S.C. 154(b) by 18 days.

(21) Appl. No.: 13/345,271

(22) Filed: Jan. 6, 2012

(65) Prior Publication Data

US 2013/0174430 A1 Jul. 11, 2013

(51) Int. Cl.
*F41G 1/467* (2006.01)

(52) U.S. Cl.
USPC ..... 33/265; 124/87

(58) Field of Classification Search
USPC ..... 33/265; 124/87, 88
See application file for complete search history.

(56) References Cited

U.S. PATENT DOCUMENTS

| | | | | |
|---|---|---|---|---|
| 3,097,432 | A | 7/1963 | Shaw | |
| 3,470,616 | A | 10/1969 | Thompson | |
| 4,400,887 | A | 8/1983 | Mason | |
| 4,417,403 | A * | 11/1983 | Strange | 33/265 |
| 4,473,959 | A | 10/1984 | Saltzman | |
| 4,625,421 | A | 12/1986 | Strauss | |
| 4,764,011 | A | 8/1988 | Goldstein | |
| 4,928,394 | A | 5/1990 | Sherman | |
| 5,080,084 | A | 1/1992 | Kendall et al. | |
| 5,121,547 | A | 6/1992 | Littlejohn | |
| 5,157,839 | A | 10/1992 | Beutler | |
| 5,168,631 | A | 12/1992 | Sherman | |
| 5,201,124 | A | 4/1993 | Sherman | |
| 5,231,765 | A | 8/1993 | Sherman | |
| 5,303,479 | A | 4/1994 | Rudovsky | |
| 5,308,986 | A | 5/1994 | Walker | |
| 5,338,037 | A | 8/1994 | Toyohara | |
| 5,384,966 | A | 1/1995 | Gibbs | |
| 5,420,959 | A | 5/1995 | Walker et al. | |
| 5,442,861 | A | 8/1995 | Lorocco | |
| 5,560,113 | A | 10/1996 | Simo et al. | |
| 5,606,638 | A | 2/1997 | Tymianski et al. | |
| 5,638,604 | A | 6/1997 | Lorocco | |
| 5,649,526 | A | 7/1997 | Ellig | |
| 5,685,081 | A | 11/1997 | Winegar | |
| 5,850,700 | A | 12/1998 | Capson et al. | |
| 5,862,603 | A | 1/1999 | Ellig | |
| RE36,266 | E | 8/1999 | Gibbs | |
| 5,956,854 | A | 9/1999 | Lorocco | |
| 6,000,141 | A | 12/1999 | Afshari | |
| 6,016,608 | A | 1/2000 | Lorocco | |
| 6,122,833 | A | 9/2000 | Lorocco | |
| 6,216,352 | B1 | 4/2001 | Lorocco | |

(Continued)

*Primary Examiner* — G. Bradley Bennett
(74) *Attorney, Agent, or Firm* — Stoel Rives LLP

(57) ABSTRACT

A bow sight that decouples the shooter's bow cant from elevation adjustments. A segmented support assembly includes a proximal portion and a distal portion. The proximal portion is adapted to attach to the bow. The distal portion is rotatably attached to the proximal portion and adapted to rotate around a Y-axis relative to the proximal portion. A micro-adjust controls the rotational position around the Y-axis of the distal portion relative to the proximal portion. An elevation assembly is attached to the distal portion. A bezel assembly is attached to the elevation assembly. The elevation adjustment moves the bezel assembly along a substantially vertical axis while the bow is held at a bow cant greater than zero. The micro-adjust decouples the shooter's bow cant from operation of the elevation assembly. A windage assembly is optionally located between the elevation assembly and the distal portion.

19 Claims, 11 Drawing Sheets

(56) References Cited

U.S. PATENT DOCUMENTS

| | | | | |
|---|---|---|---|---|
| 6,311,405 | B1 | 11/2001 | Slates | |
| 6,360,472 | B1 | 3/2002 | Lorocco | |
| 6,385,855 | B1 | 5/2002 | Tymianski | |
| 6,421,946 | B1 | 7/2002 | LoRocco | |
| 6,477,778 | B1 | 11/2002 | Lorocco | |
| 6,477,780 | B2 | 11/2002 | Aldred | |
| 6,557,291 | B2 | 5/2003 | Hoadley | |
| 6,560,884 | B1 | 5/2003 | Afshari | |
| 6,564,462 | B1 | 5/2003 | Henry | |
| 6,571,482 | B1 | 6/2003 | Tymianski | |
| 6,581,317 | B1 | 6/2003 | Slates | |
| 6,634,110 | B2 | 10/2003 | Johnson | |
| 6,634,111 | B2 | 10/2003 | LoRocco | |
| 6,725,854 | B1 | 4/2004 | Afshari | |
| 6,796,037 | B1 | 9/2004 | Geffers et al. | |
| 6,802,129 | B1 | 10/2004 | Wirth | |
| 6,817,105 | B2 | 11/2004 | LoRocco | |
| 6,938,349 | B2 | 9/2005 | Afshari | |
| 6,981,329 | B1 | 1/2006 | Strathman | |
| 7,036,234 | B2 | 5/2006 | Rager | |
| 7,200,943 | B2 | 4/2007 | Afshari | |
| 7,290,345 | B2 | 11/2007 | Ellig | |
| 7,331,112 | B2 | 2/2008 | Gibbs | |
| 7,461,460 | B2 | 12/2008 | Priebe | |
| 7,464,477 | B2 | 12/2008 | Afshari | |
| 7,503,122 | B2 | 3/2009 | Afshari | |
| 7,503,321 | B2 | 3/2009 | Afshari | |
| 7,562,486 | B2 | 7/2009 | LoRocco | |
| 7,574,810 | B1 | 8/2009 | LoRocco | |
| 7,574,811 | B2 | 8/2009 | Kurtzhals et al. | |
| 7,814,668 | B1 | 10/2010 | Pulkrabek et al. | |
| 7,832,109 | B2 | 11/2010 | Gibbs et al. | |
| 7,921,570 | B1 | 4/2011 | Pulkrabek et al. | |
| 7,958,643 | B1 | 6/2011 | Wu | |
| 8,079,153 | B2 | 12/2011 | Pulkrabek et al. | |
| 8,186,068 | B2 | 5/2012 | Pulkrabek et al. | |
| 2003/0056379 | A1* | 3/2003 | Johnson et al. | 33/265 |
| 2003/0110647 | A1 | 6/2003 | Henry | |
| 2005/0235503 | A1 | 10/2005 | Afshari | |
| 2007/0028467 | A1 | 2/2007 | Bradley et al. | |
| 2007/0163131 | A1* | 7/2007 | Gibbs | 33/265 |
| 2009/0199418 | A1 | 8/2009 | LoRocco | |
| 2011/0277329 | A1 | 11/2011 | Summers et al. | |
| 2012/0255187 | A1* | 10/2012 | Sims et al. | 33/265 |
| 2012/0297659 | A1* | 11/2012 | Lattimer | 124/87 |
| 2013/0174431 | A1* | 7/2013 | Pulkrabek et al. | 33/228 |

* cited by examiner

MULTI-AXIS BOW SIGHT

FIELD OF THE INVENTION

The present disclosure is directed to a multi-axis bow sight that decouples bow cant from operation of the elevation and windage adjustments.

BACKGROUND OF THE INVENTION

FIG. 1 illustrates a bow sight 20 with elevation assembly 22 that permits rapid movement along a fine adjustment screw, such as disclosed in U.S. Pat. Nos. RE 36,266 (Gibbs) and 7,331,112 (Gibbs). The Gibbs patents disclose a slidable three-point stabilizing mounting for the elevation assembly that can be adjusted without need of manually holding a coupling/uncoupling device in an uncoupled position during the adjustment.

The elevation assembly 22 permits the shooter to raise and lower the bezel 24 relative to the bow sight 20 along vertical axis 26 to compensate for distance. Windage assembly 32 permits the shooter to move the bezel 24 along horizontal axis 34 to compensate for wind conditions. The operation of the elevation and windage assemblies 22 32, however, is dependent on the bow 28 being held vertical, as illustrated in FIG. 2.

Human physiology is such that when the arm muscles are in a relaxed state the shooters has a natural tendency to hold a bow at an angled or canted position. Alternatively, the shooter may have a preferred angle or cant for holding the bow. As used herein, "bow cant" refers to a shooter's natural and/or preferred angle for holding a bow relative to vertical. Right-handed shooters cant or angle the bow 28 to the left and left-handed shooters cant the bow 28 to the right. The degree of cant varies between shooters, but is generally in the range of about 20 degrees.

FIG. 3 illustrates the bow 28 held at a bow cant 30 relative to vertical 26 by a right-handed shooter. As a result of the bow cant 30, the elevation assembly moves the bezel 24 to one side or the other as it moves along non-vertical axis 36, reducing shooting accuracy. Similarly, the windage assembly moves the bezel 24 up or down as it moves along non-horizontal axis 38.

The Gibbs '112 patent discloses a bow cant adjustment that permits the bezel 24 to be rotated level relative to the shooter as illustrated in FIG. 4. The cant adjustment, however, is located adjacent the bezel 24 so the elevation assembly 22 and the windage assembly 32 are still canted at bow cant angle 30 relative to vertical 26. Consequently, adjustment of the elevation assembly 22 or windage assembly 32 causes the bezel 24 to travel along the axes 36, 38, as illustrated in FIG. 3.

BRIEF SUMMARY OF THE INVENTION

The present disclosure is directed to a bow sight that permits the bow to be held at to the shooter's natural or preferred bow cant, while maintaining a micro-adjustable elevation assembly in a vertical configuration and the windage assembly in a horizontal configuration. Compensation for the shooter's bow cant is performed with a micro-adjust mechanism that smoothly and precisely rotates the bezel, elevation assembly, and windage assembly relative to the bow.

One embodiment is directed to a bow sight that decouples the shooter's bow cant from elevation and windage adjustments. The bow sight includes a segmented support assembly with a proximal portion, and intermediate portion, and a distal portion. The proximal portion is adapted to attach to the bow.

The intermediate portion is rotatably attached to the proximal portion and rotates around a Y-axis relative to the proximal portion. The distal portion is pivotally attached to the intermediate portion and pivots around a Z-axis relative to the intermediate portion. A first micro-adjust controls the rotational position around the Y-axis of the intermediate portion relative to the proximal portion. A second micro-adjust controls the pivotal position around the Z-axis of the distal portion around the intermediate portion. An adjustable elevation assembly and an adjustable windage assembly are attached to the distal portion. A bezel assembly is attached to the elevation assembly and the windage assembly. The elevation adjustment is adapted to move the bezel assembly along a substantially vertical axis and the windage adjustment is adapted to move the bezel assembly along a substantially horizontal axis while the bow is held at a bow cant greater than zero. The elevation and windage assembly optionally including a windage micro-adjust and an elevation micro-adjust.

The first micro-adjust preferably provides an adjustment of +/−15 degrees relative to horizontal. The first micro-adjusts preferably include a threaded traveler engaged with the lead screw where the lead screw is parallel to the X-axis. The lead screw is located offset from an axis of a pivot pin attaching the intermediate portion to the proximal portion. The second micro-adjust includes a lead screw located offset from an axis of a pivot pin attaching the distal portion to the intermediate portion. A adjustment knob is preferably provided for each of the lead screws.

In one embodiment, a plurality of detents are located on the lead screw. A member is biases into engagement with the detents to provide feedback to the shooter during adjustment. Set screws are preferably provided to secure the first and second micro-adjusts after the adjustments have been made.

In another embodiment, the elevation and windage assembly includes an adjustable windage assembly attached to the distal portion and an adjustable elevation attached to the windage assembly. The bezel assembly is attached to the elevation assembly. Indicia are preferably provided as an indication of a degree of rotation of the intermediate portion relative to the proximal portion.

In one embodiment, the bezel includes an opening that extends toward a sight point located in the bezel opening. A light assembly is provided that engages with the opening and transmits light onto the sight pin or aiming indicia located in the bezel opening.

A level assembly is optionally engaged with a curved surface on the bezel. Set screws on the bezel are provided to calibrate the level assembly along the curved surface.

The present disclosure is also directed to a bow sight that decouples the shooter's bow cant from windage adjustments. The segmented support assembly includes a proximal portion and a distal portion. The proximal portion is adapted to attach to the bow. The distal portion is rotatably attached to the proximal portion and rotates around the Y-axis relative to the proximal portion. A micro-adjust controls the rotational position around the Y-axis of the distal portion relative to the proximal portion. A windage assembly is attached to the distal portion. A bezel assembly is attached to the windage assembly. The windage adjustment moves the bezel assembly along a substantially horizontal axis while the bow is held at a bow cant greater than zero. In one embodiment, the windage assembly includes a windage micro-adjust. An adjustable elevation assembly is optionally interposed between the distal portion and the windage assembly.

The present disclosure is also directed to a bow sight that decouples the shooter's bow cant from elevation adjustments.

The segmented support assembly includes a proximal portion and a distal portion. The proximal portion is adapted to attach to the bow. The distal portion is rotatably attached to the proximal portion and rotates around the Y-axis relative to the proximal portion. A micro-adjust controls the rotational position around the Y-axis of the distal portion relative to the proximal portion. An elevation assembly is attached to the distal portion. A bezel assembly is attached to the elevation assembly. The elevation assembly moves the bezel assembly along a substantially vertical axis while the bow is held at a bow cant greater than zero. In one embodiment, an adjustable windage assembly interposed between the distal portion and the elevation assembly.

The present disclosure is also directed to a method of adjusting a bow sight for a shooter's bow cant. The method includes attaching a proximal portion of a segmented support assembly to the bow. The shooter holds the bow at the shooter's bow cant. A micro-adjust is operated to rotate a distal portion of the segmented support assembly around a Y-axis on the proximal portion until a bezel is substantially horizontal. An elevation assembly attached to the distal portion is operated to move the bezel assembly along a substantially vertical axis while the bow is held at the shooter's bow cant. The micro-adjust decouples the shooter's bow cant from operation of the elevation assembly.

In one embodiment, the present method includes operating a windage micro-adjust on a windage assembly interposed between the distal portion and the elevation assembly.

DETAILED DESCRIPTION OF THE INVENTION

Figure 1:
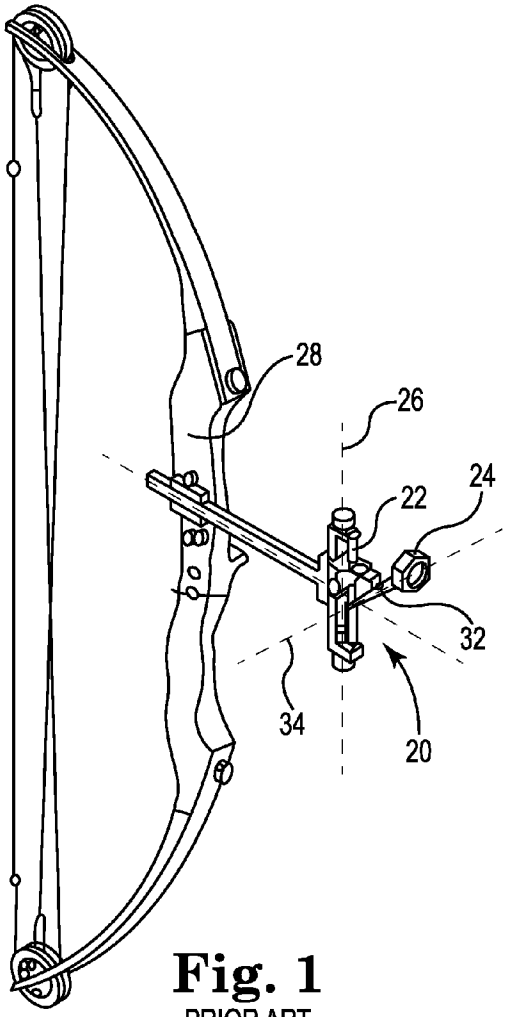
Fig. 1 PRIOR ART
FIG. 1 is a perspective view of a compound bow with a prior art elevation assembly and windage assembly.
Figure 4:
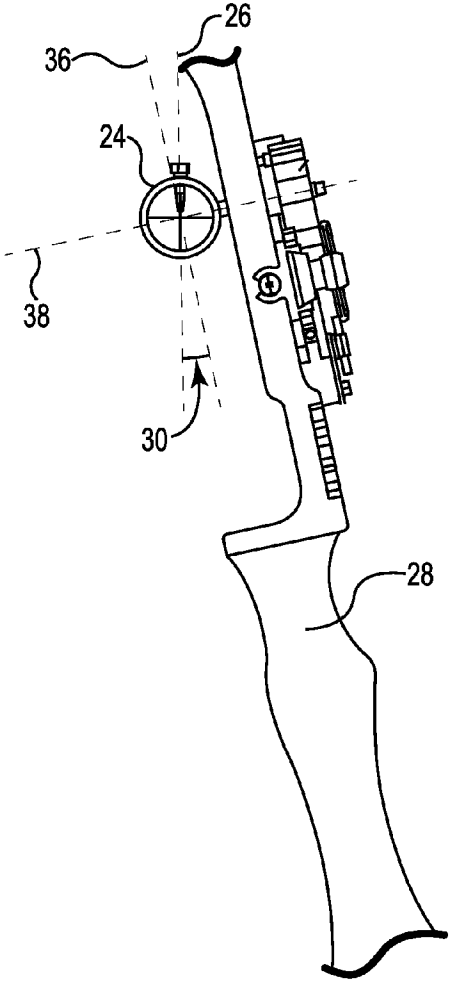
Fig. 4 PRIOR ART
FIG. 4 is a rear view of the bow of FIG. 3 with the bezel rotated to compensate for the bow cant.
Figure 3:
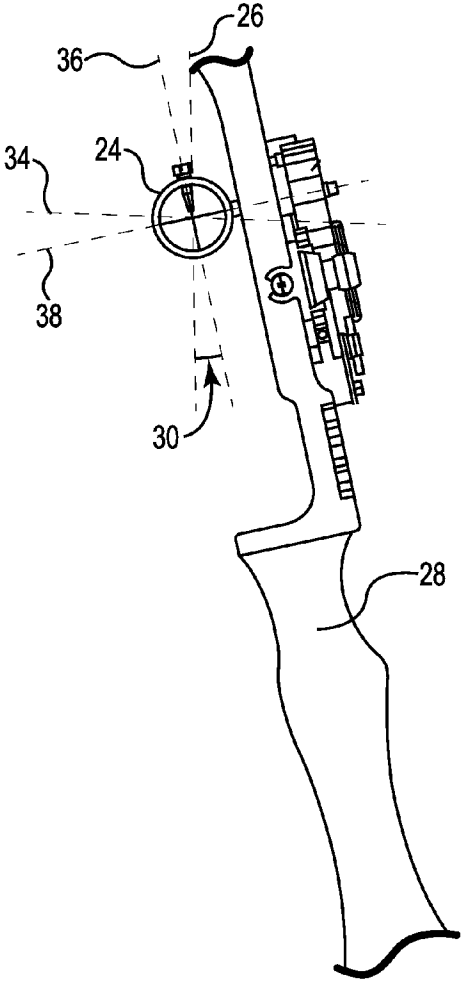
Fig. 3 PRIOR ART
FIG. 3 is a rear view of the bow of FIG. 1 held at a shooter's bow cant by a right-handed shooter.
Figure 5:
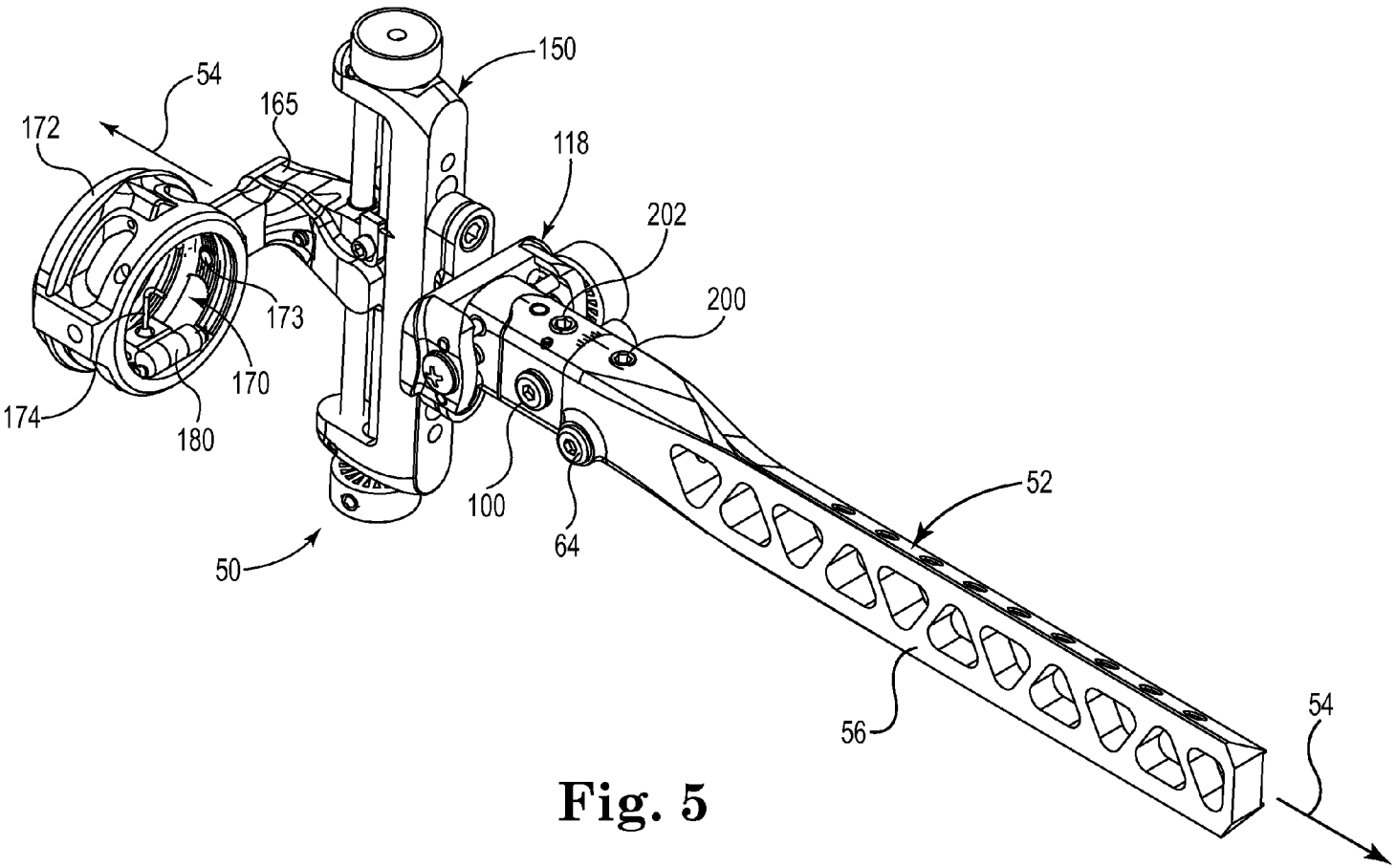
FIG. 5 is a perspective view of a multi-axis bow sight in accordance with an embodiment of the present disclosure.

FIG. 5 illustrates a multi-axis bow sight 50 in accordance with an embodiment of the present disclosure. The bow sight 50 includes multi-segmented support assembly 52 that attaches to a bow in front of the riser, generally as illustrated in FIG. 1. Proximal portion 56 of the support assembly 52 is attached to a bow using a variety of sliding mounting structures that permit adjustment along the Y-axis 54, such as disclosed in U.S. Pat. No. 7,832,109 (Gibbs), which is hereby incorporated by reference. As used herein, references to "X-axis," "Y-axis," or "Z-axis" relate to an orthogonal coordinate system that is used to describe the relative position of features on the bow sight 50, and not necessarily related to absolute vertical or horizontal unless otherwise stated.

Figure 6:
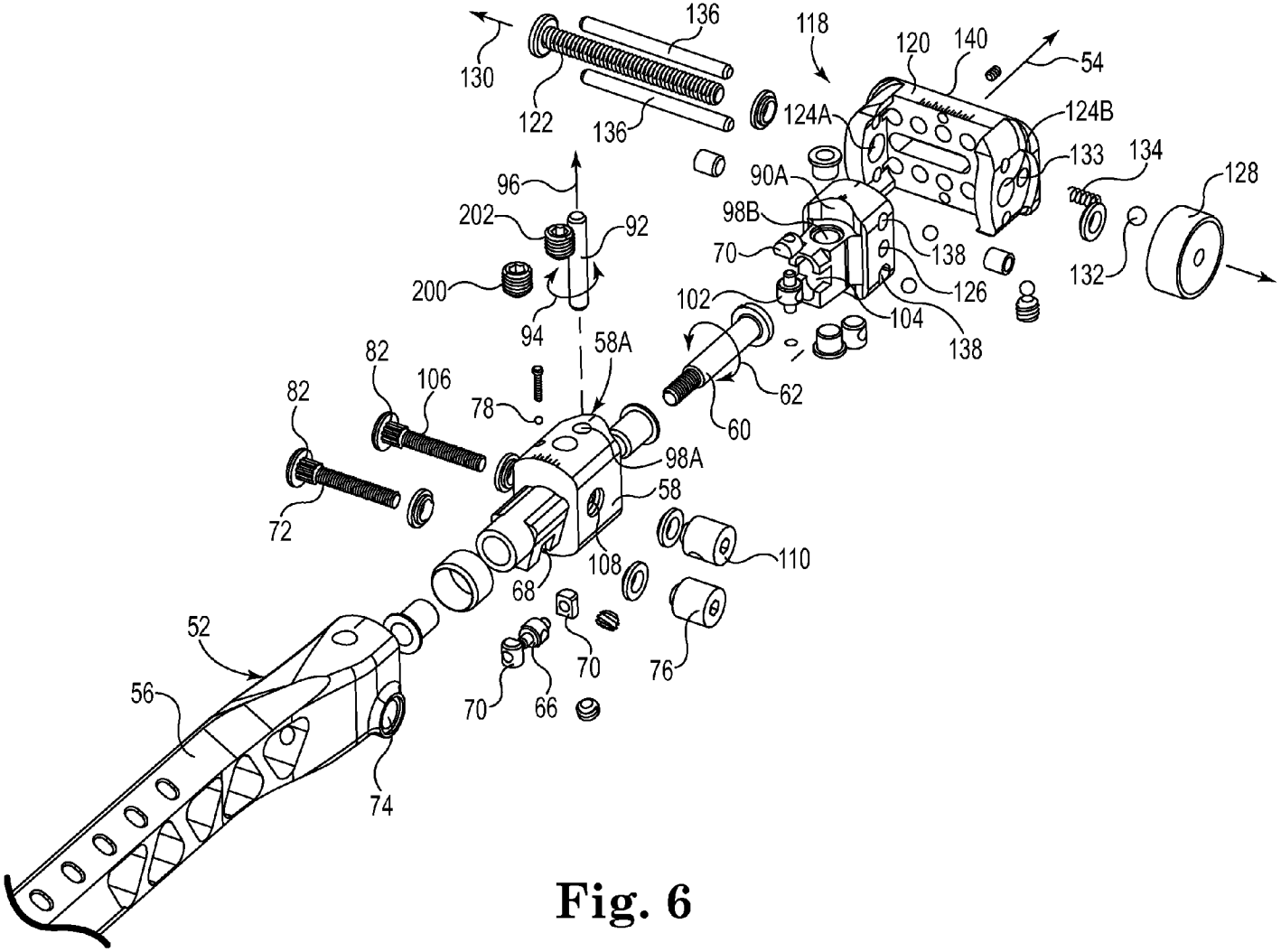
FIG. 6 is an exploded view of a mounting structure of the bow sight of FIG. 5.

FIG. 6 is an exploded view of the support assembly 52 of FIG. 5. Proximal portion 56 attaches to the bow as noted above. Intermediate portion 58 is rotatably attached to the proximal portion 56 by pivot pin 60. Pivot pin 60 permits the intermediate portion 58 to rotate in direction 62 around the longitudinal or Y-axis 54 of the proximal portion 56.

Figure 7:
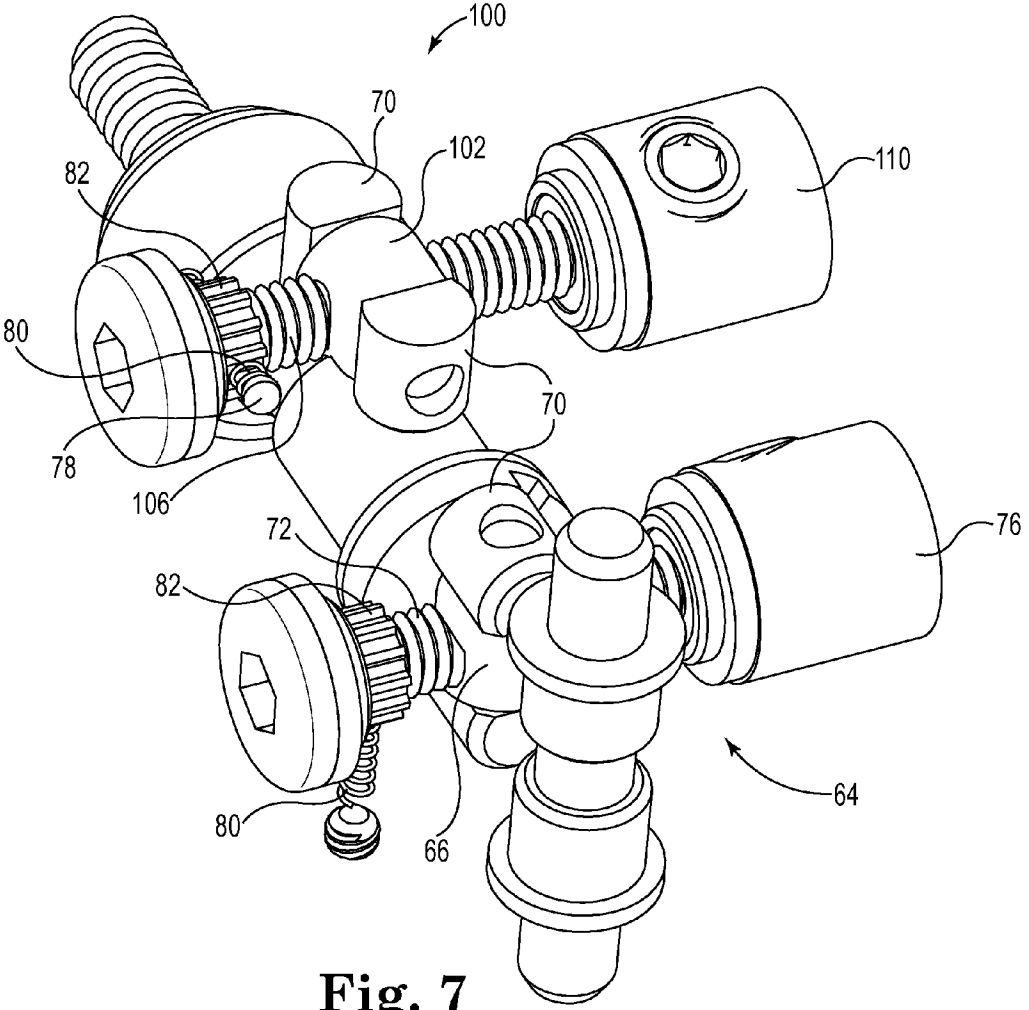
FIG. 7 is a perspective view of a micro-adjust for a bow sight in accordance with an embodiment of the present disclosure.

Rotational position of the intermediate portion 58 relative to the proximal portion 56 is controlled by micro-adjust assembly 64 illustrated in FIGS. 6 and 7. Threaded traveler 66 is rotatably attached to intermediate portion 58 in cavity 68 by polymeric washers 70. In the illustrated embodiment the washers 70 are made from Delrin®. Lead screw 72 extends through holes 74 in the proximal portion 56 and engages with the threads in the traveler 66. Since the cavity 68 is located offset from the axis of the pivot pin 60, rotation of knob 76 displaces the traveler 66 left or right, resulting in rotational movement 62 of the intermediate portion 58 relative to the proximal portion 56 (see e.g., FIG. 11B). Ball bearing 78 is preferably biased by spring 80 to engage teeth 82 on the lead screw 72 to provide feedback during rotation of the knob 76. The teeth 82 act also as detents to reduce the risk of inadvertent rotation of the lead screw 72.

As used herein, "micro-adjust" refers to an assembly including a threaded traveler engaged with threads of a precision lead screw to precisely control the relative position of two components. For example, the threads can have a pitch of about 0.5 millimeters (50.8 threads per inch), with a sensitivity of less than about 2 micrometers. A setscrew preferably locks the micro-adjust in the desired position.

Turning back to FIG. 6, distal portion 90 is optionally pivotally attached to the intermediate portion 58 by pivot pin 92 extending through holes 98A, 98B. Pivot pin 92 permits the distal portion 90 to rotate in direction 94 around Z-axis 96 in a plane perpendicular to the Z-axis 96. Complementary curved surfaces 58A, 90A at the interface of the intermediate portion 58 to the distal portion 90 facilitate rotation 94. Rotational position of the distal portion 58 is controlled by micro-adjust assembly 100.

Threaded traveler 102 is rotatably attached to distal portion 90 in cavity 104 by polymeric washers 70. Lead screw 106 extends through holes 108 in the intermediate portion 58 and engages with the threads in the traveler 102. Since the cavity 104 is located offset from the Z-axis 96, rotation of knob 110 displaces the traveler 102 left or right, resulting in rotational movement 94 of the distal portion 90 relative to the intermediate portion 58 (see e.g., FIGS. 12B and 12C). Ball bearing 78 is biased toward teeth 82 on the lead screw 106 to provide feedback during rotation of the knob 110 and to reduce the risk of inadvertent rotation of the lead screw 106.

Figure 8:
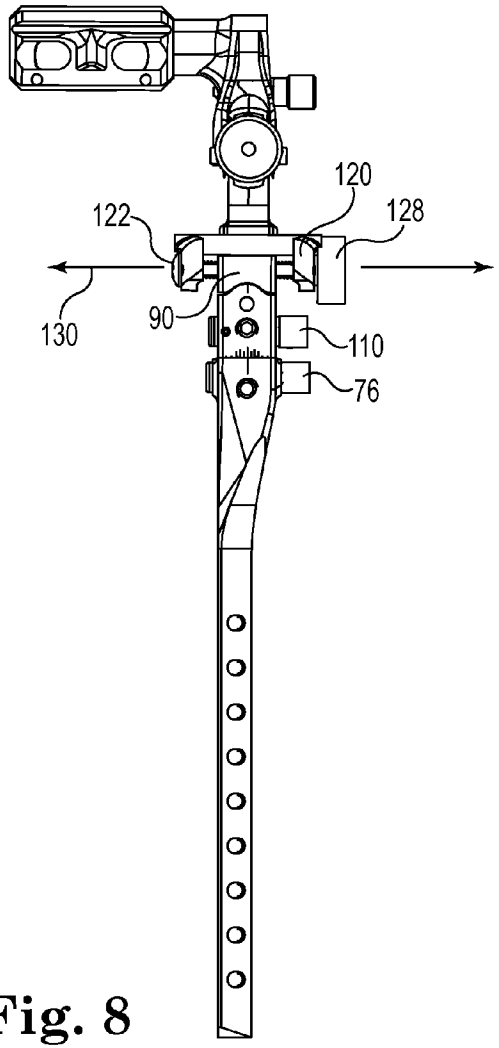
FIG. 8 is a top view of the bow sight of FIG. 5.

Windage assembly 118 illustrated in FIGS. 6 and 8 compensates for wind conditions. Windage block 120 is attached to distal portion 90 by lead screw 122. The lead screw 122 passes through opening 124A in the windage block 120, engages with threaded hole 126 in the distal portion 90, and passed through opposite opening 124B to engaged with knob 128. Rotation of the knob 128 causes the windage block 120 to be displaced left and right relative to the distal portion 90 along X-axis 130. Windage block 120 includes indicia 140 to provide an indication of position relative to the intermediate portion 90.

Ball bearing 132 located in recess 133 in windage block 120 is preferably biased by spring 134 against detents on knob 128. Pins 136 extend through holes 138 in the distal portion 90 to stabilize movement of the windage block 120 along the X-axis 130.

Figure 9:
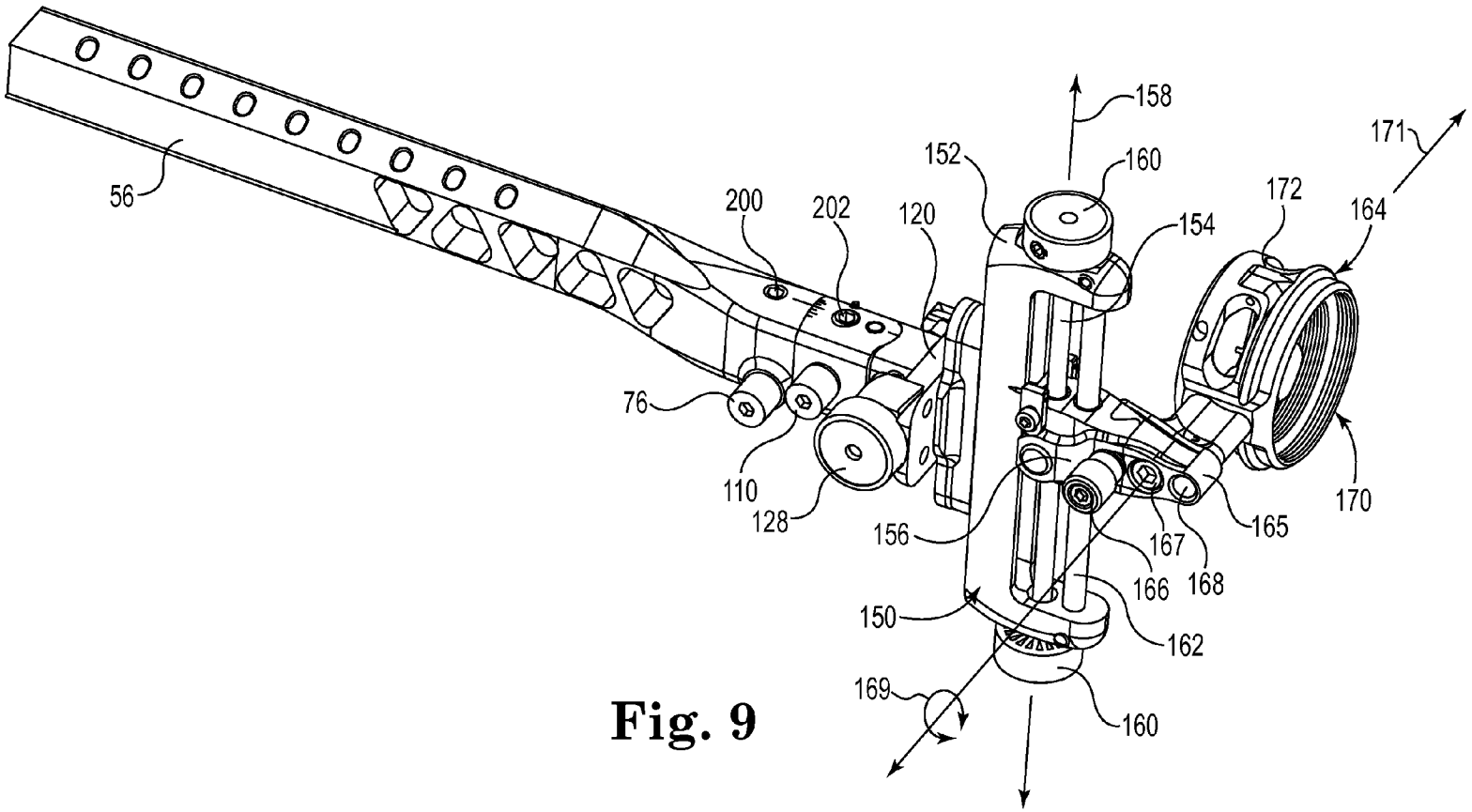
FIG. 9 is an alternate perspective view of the bow sight of FIG. 5.
Figure 10:
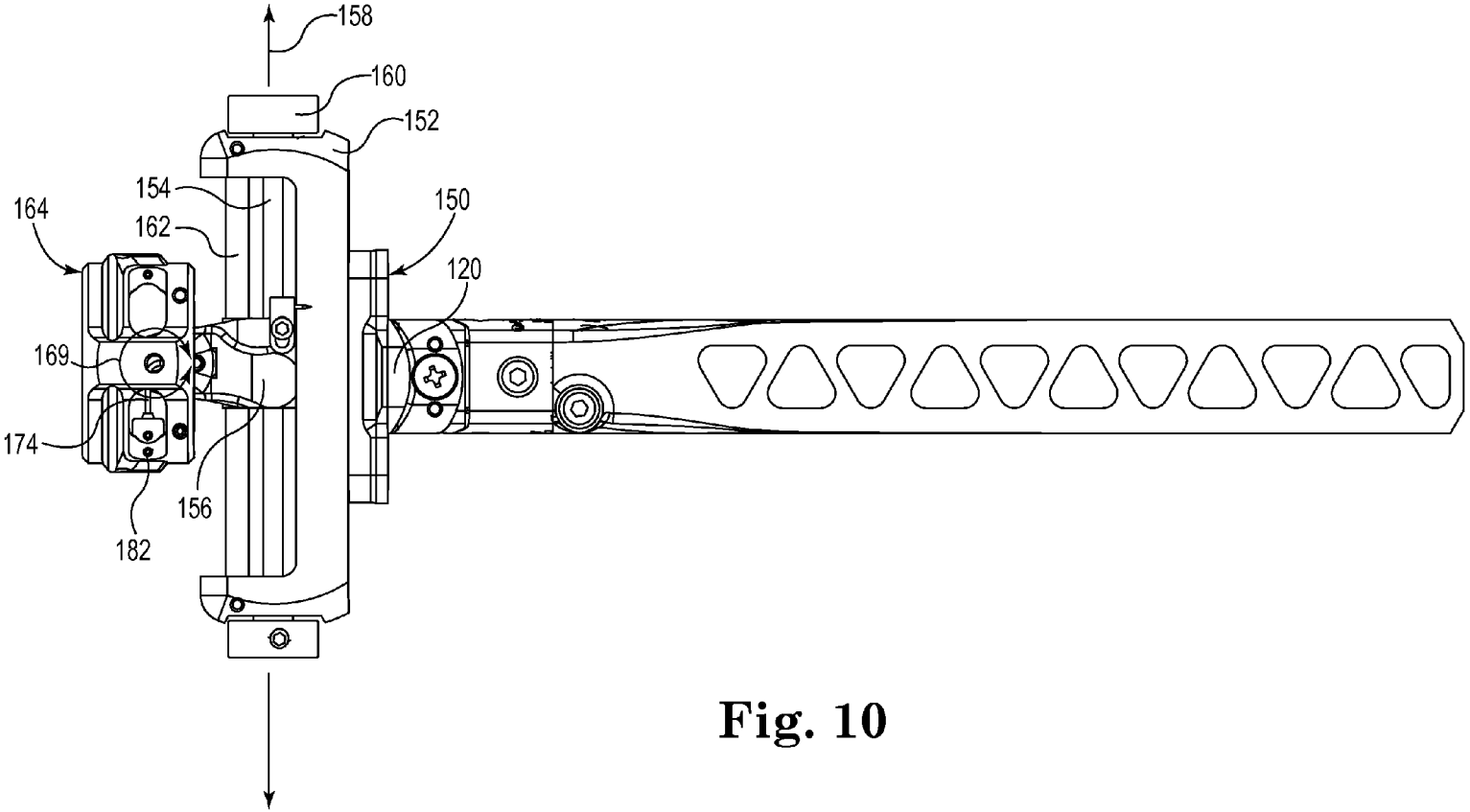
FIG. 10 is a side view of the bow sight of FIG. 5.

As best illustrated in FIGS. 9 and 10, elevation assembly 150 is attached to windage block 120. Elevation block 152 includes a finely threaded lead screw 154 adapted to move bezel traveler 156 along Z-axis 158. Knobs 160 are located at the top and bottom of the elevation block 152 to facilitate rotation of the lead screw 154. Pin 162 stabilizes the bezel traveler 156 during movement along the Z-axis 158.

Bezel assembly 164 is attached to the bezel traveler 156 by fastener 166. In the illustrated embodiment, the bezel assembly 164 includes bezel bracket 165 attached to bezel 172 by fastener 167. By loosening the fastener 167, the bezel 172 can be rotated in directions 169 around axis 171 that is parallel to Y-axis 130 (see also, FIG. 10). The bezel bracket 165 includes opening 168 that extends to bezel opening 170 of bezel 172. In embodiments using sight pin 174 with illuminated optical fibers, plug 173 is located in opening 168 (see FIG. 5). In an alternate embodiment where a targeting reticle is located in the bezel opening 170, a battery powered light assembly 176 is optionally attached to the opening 168 (see e.g., FIG. 12A). The light is transmitted through the opening 168 into the bezel opening 170 to illuminate the targeting reticle. A reticle refers to a net of fine lines or fibers in the eyepiece of a sighting device. A variety of different bezel assemblies can be attached to the bezel traveler 156 in accordance to embodiments of the present invention.

As illustrated in FIG. 5, level 180 is located at bottom edge of the bezel 172. Set screws 182 at the base of the bezel 172 engage with recesses at opposite ends of the level 180 to shift the level 180 along the curved surface of the bezel 172. The set screws 182 serve as micro-adjusts that permit fine adjustment/calibration of the level 180.

Figure 2:
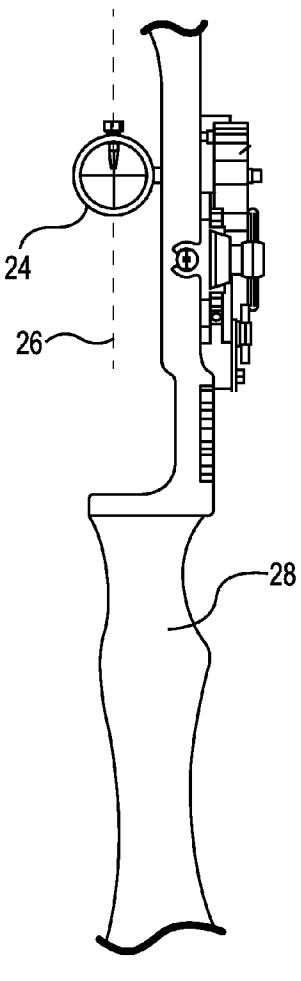
Fig. 2 PRIOR ART
FIG. 2 is a rear view of the bow of FIG. 1 held in a vertical configuration.
Figure 11B:
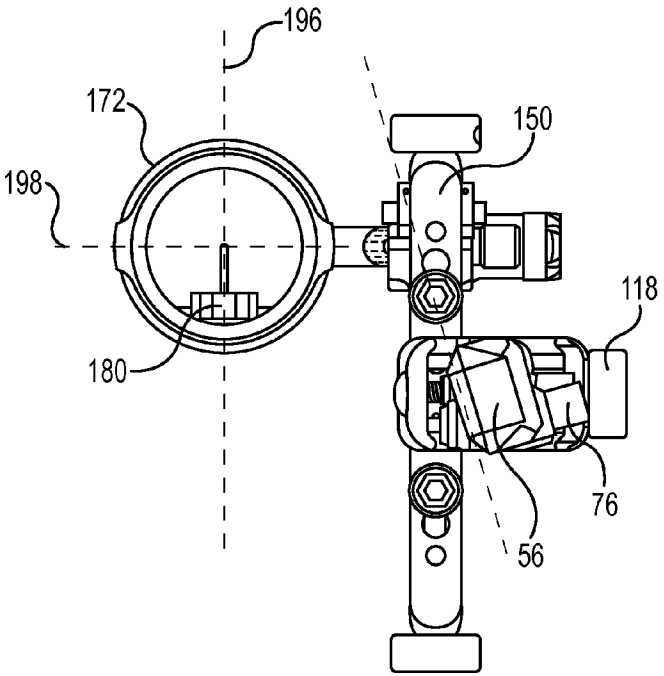
FIG. 11B is a rear view of the bow sight of FIG. 5 with the support assembly rotated to compensate for the bow cant of FIG. 11A.
Figure 11A:
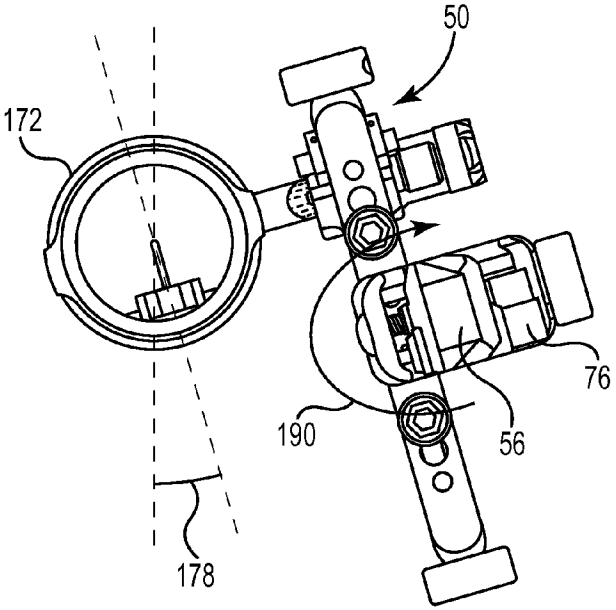
FIG. 11A is rear views of the bow sight of FIG. 5 held at a shooter's bow cant by a right-handed shooter.

FIG. 11A illustrates operation of the bow sight 50 with the bow removed for clarity. The shooter holds the bow in a natural or preferred bow canted, as discussed above in connection with FIG. 2. FIG. 11A illustrates the bow sight 50 canted to the left for a right-handed shooter by an amount corresponding to the shooter bow cant 178. The typical bow cant 178 is on the order of about 10 degrees to about 20 degrees.

Set screw 200 (see FIG. 9) on the proximal portion 56 is loosened to permit the knob 76 to be turned. As the shooter rotates the knob 76, the micro-adjust 64 precisely rotates the intermediate portion 58 relative to the proximal portion 56 until the bezel 172 is level, as illustrated in FIG. 11B. The level 180 aids in the adjustment.

Since this adjustment is specific to the particular shooter, once the adjustment is completed the set screw 200 is tightened to secure the micro-adjust 64. Because the interface between the proximal portion 56 and intermediate portion 58 is located closest to the bow, the windage assembly 118 and elevation assembly 150 both rotate around the Y-axis 54 in direction 190 with the bezel 172. As a result, subsequent adjustment of the elevation assembly 150 causes the bezel 172 and sight pin 174 to travel along a vertical axis 196. Similarly, adjustments of the windage assembly 118 causes the bezel 172 to travel along a horizontal axis 198.

Figure 12C:
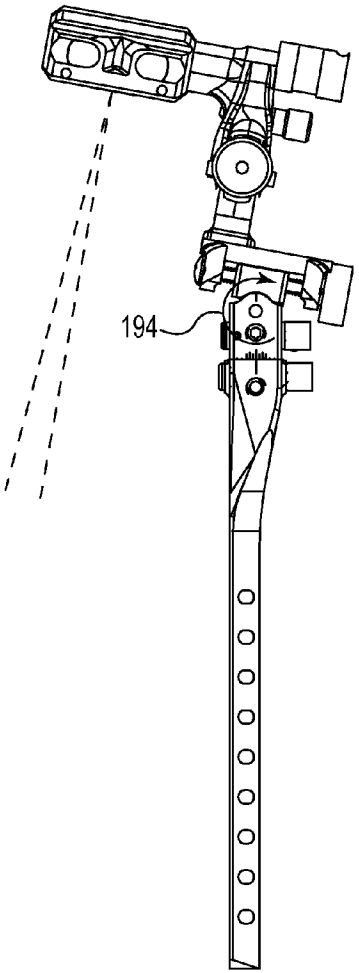
FIG. 12C is top views of the bow sight of FIG. 5 with the support assembly rotated so the bezel is rotated clockwise in accordance with an embodiment of the present disclosure.
Figure 12B:
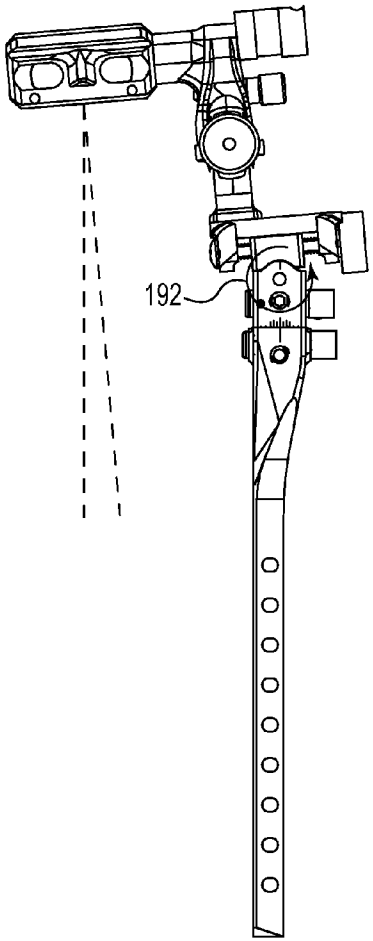
FIG. 12B is top views of the bow sight of FIG. 5 with the support assembly rotated so the bezel is rotated counterclockwise in accordance with an embodiment of the present disclosure.
Figure 12A:
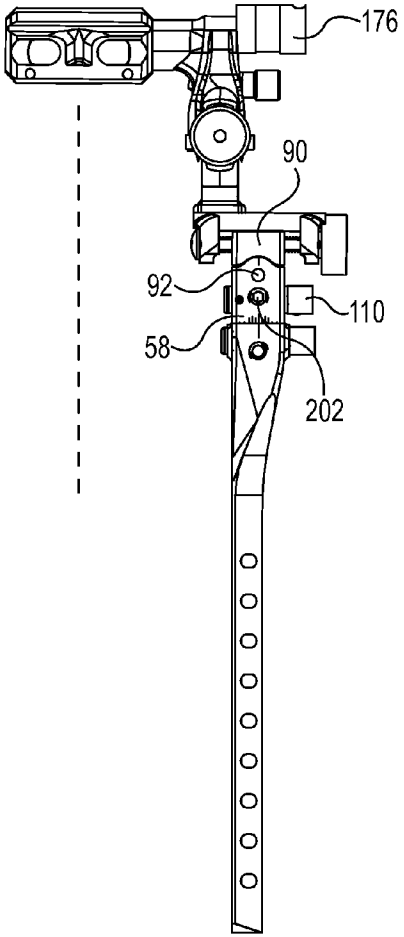
FIG. 12A is top views of the bow sight of FIG. 5 with the bezel in a neutral position in accordance with an embodiment of the present disclosure.

FIGS. 12A-12C illustrate front and back adjustment of the bezel 172 around the Z-axis 96. Set screw 202 (see FIG. 9) is loosened and the knob 110 is turned to activate micro-adjust 100. The distal portion 90 rotates around pivot pin 92 relative to the intermediate portion 58. Depending on the direction of rotation of the knob 110, the bezel 172 may rotate counterclockwise (toward the shooter) as illustrated in FIG. 12B or clockwise 192 (away from the shooter) as illustrated in FIG. 12C. Once the adjustment is completed the set screw 202 is tightened.

Figure 13:
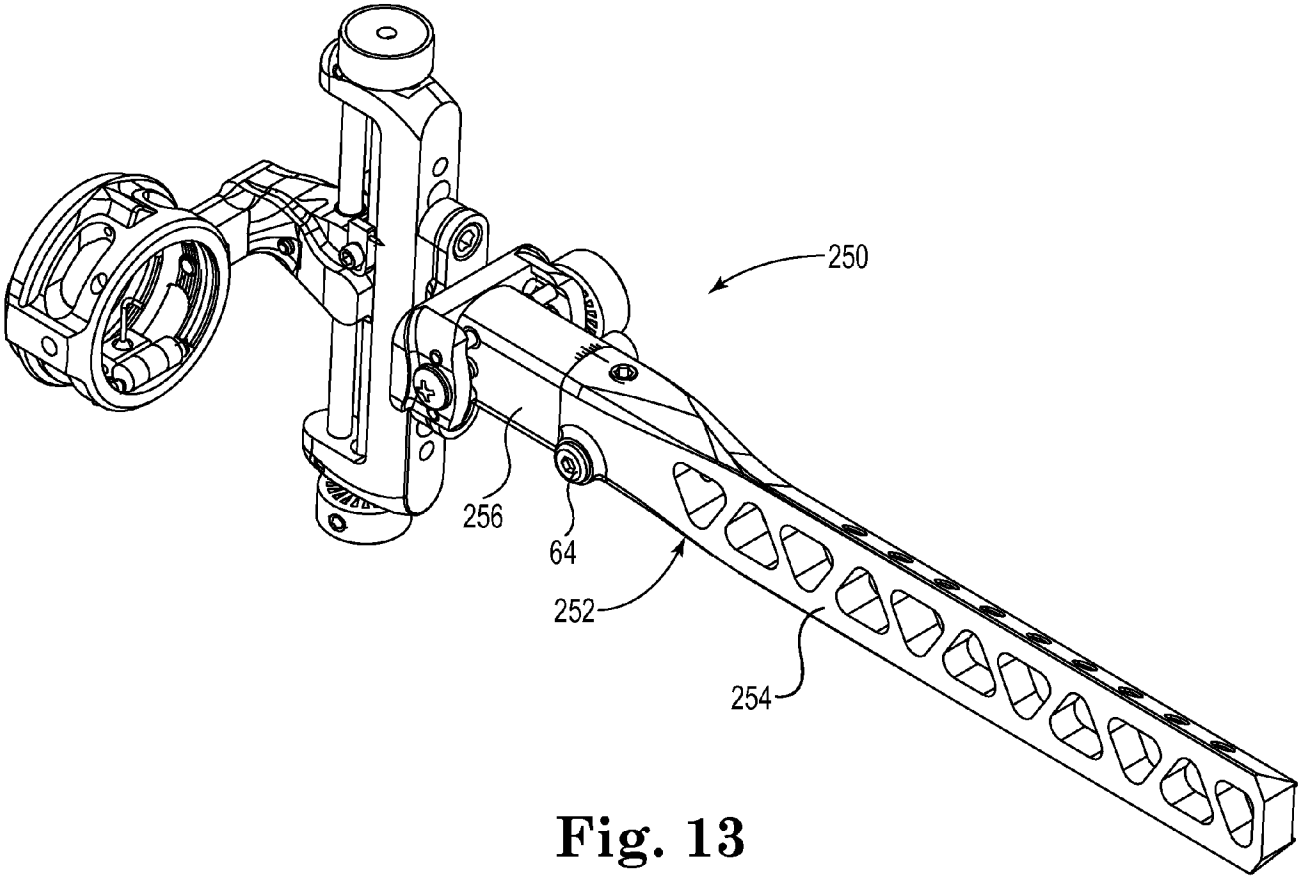
FIG. 13 illustrates an alternate bow sight in accordance with an embodiment of the present disclosure.

FIG. 13 illustrates an alternate multi-axis bow sight 250 with a two-piece segmented support assembly 252 in accordance with an embodiment of the present disclosure. The segmented support assembly 252 includes a proximal portion 254 that attaches to a bow and a distal portion 256. The distal portion 256 is pivotally attached to the proximal portion 254 using pivot pin 62 (see FIG. 6). The rotational position of the distal portion 256 relative to the proximal portion 254 is controlled using micro-adjust 64 (see FIG. 7). The embodiment of FIG. 13 combines the intermediate portion 58 with the distal portion 90 as a single component 256, eliminating the need for the micro-adjust 100. The bow sight 250 is otherwise substantially the same as the bow sight 50 discussed above.

Where a range of values is provided, it is understood that each intervening value, to the tenth of the unit of the lower limit unless the context clearly dictates otherwise, between the upper and lower limit of that range and any other stated or intervening value in that stated range is encompassed within the disclosure. The upper and lower limits of these smaller ranges which may independently be included in the smaller ranges is also encompassed within the disclosure, subject to any specifically excluded limit in the stated range. Where the stated range includes one or both of the limits, ranges excluding either both of those included limits are also included in the disclosure.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. A bow sight that decouples the shooter's bow cant from elevation and windage adjustments, the bow sight comprising:

a segmented support assembly comprising;

a proximal portion that is adapted to attach to the bow, the proximal portion comprising a Y-axis;

an intermediate portion rotatably attached to the proximal portion and adapted to rotate around the Y-axis relative to the proximal portion;

a distal portion pivotally attached to the intermediate portion and adapted to pivot around a Z-axis relative to the intermediate portion;

a first micro-adjust adapted to control the rotational position around the Y-axis of the intermediate portion relative to the proximal portion;

a second micro-adjust adapted to control the pivotal position around the Z-axis of the distal portion around the intermediate portion;

an adjustable elevation assembly and an adjustable windage assembly attached to the distal portion; and a bezel assembly attached to the elevation and windage assemblies, wherein the elevation assembly is adapted to move the bezel assembly along a substantially vertical axis and the windage assembly is adapted to move the bezel assembly along a substantially horizontal axis while the bow is held at a bow cant greater than zero, wherein the first micro-adjust decouples the shooter's bow cant from operation of the elevation assembly and the windage assembly.

2. The bow sight of claim 1 wherein the first micro-adjust is adapted to provide an adjustment of +/−15 degrees relative to horizontal.

3. The bow sight of claim 1 wherein the first micro-adjust comprises:

a threaded traveler;

a lead screw parallel to the X-axis and engaged with the threaded traveler, the lead screw located offset from an axis of a pivot pin attaching the intermediate portion to the proximal portion; and a knob attached to the lead screw.

4. The bow sight of claim 3 comprising:

a plurality of detents on the lead screw; and a member biases into engagement with the detents.

5. The bow sight of claim 1 wherein the second micro-adjust comprises:

a threaded traveler;

a lead screw parallel to the X-axis and engaged with the threaded traveler, the lead screw located offset from an axis of a pivot pin attaching the distal portion to the intermediate portion; and a knob attached to the lead screw.

6. The bow sight of claim 1 comprising set screws adapted to secure the first and second micro-adjusts.

7. The bow sight of claim 1 wherein the elevation assembly comprises an elevation micro-adjust and the windage assembly comprises a windage micro-adjust.

8. The bow sight of claim 1 wherein the windage assembly is attached to the distal portion and the elevation assembly is attached to the windage adjustment.

9. The bow sight of claim 1 comprising:

an opening in the bezel extending toward a sighting device located in the opening bezel; and a light assembly adapted to releasably engage with the opening to direct light toward the sighting device.

10. The bow sight of claim 1 comprising:

a level assembly adapted to engage with a curved surface on the bezel; and set screws on the bezel adapted to shift the level assembly along the curved surface.

11. A bow sight that decouples the shooter's bow cant from elevation adjustments, the bow sight comprising:

a segmented support assembly comprising;

a proximal portion that is adapted to attach to the bow, the proximal portion comprising a Y-axis;

a distal portion rotatably attached to the proximal portion and adapted to rotate around the Y-axis relative to the proximal portion;

a micro-adjust adapted to control the rotational position around the Y-axis of the distal portion relative to the proximal portion;

a windage assembly attached to the distal portion, the windage assembly including a windage micro-adjust; and a bezel assembly attached to the windage assembly, wherein the windage micro-adjust is adapted to move the bezel assembly along a substantially horizontal axis while the bow is held at a bow cant greater than zero, wherein the micro-adjust decouples the shooter's bow cant from operation of the windage assembly.

12. The bow sight of claim 11 wherein the micro-adjust is adapted to provide an adjustment of +/−15 degrees relative to horizontal.

13. The bow sight of claim 11 wherein the micro-adjust comprises:

a threaded traveler;

a lead screw parallel to the X-axis and engaged with the threaded traveler, the lead screw located offset from an axis of a pivot pin attaching the intermediate portion to the proximal portion; and a knob attached to the lead screw.

14. The bow sight of claim 13 comprising:

a plurality of detents on the lead screw; and a member biases into engagement with the detents.

15. The bow sight of claim 1 comprising an adjustable elevation assembly interposed between the distal portion and the windage assembly.

16. A method of adjusting a bow sight for a shooter's bow cant, the method comprising the steps of:

attaching a proximal portion of a segmented support assembly to the bow, the proximal portion including a Y-axis;

holding the bow at the shooter's bow cant;

operating a micro-adjust to rotate a distal portion of the segmented support assembly around the Y-axis relative to the proximal portion until a bezel is substantially horizontal; and operating an elevation adjustment on an elevation assembly attached to the distal portion to move the bezel assembly along a substantially vertical axis while the bow is held at the shooter's bow cant, wherein the micro-adjust decouples the shooter's bow cant from operation of the elevation assembly.

17. The method of claim 16 comprising the step of operating an elevation micro-adjust on the elevation assembly.

18. The method of claim 16 comprising the step of operating a windage micro-adjust on a windage assembly interposed between the distal portion and the elevation assembly.

19. The method of claim 16 wherein the step of operating a micro-adjust comprises the steps of:

rotating a lead screw;

displacing a threaded traveler along a length of the lead screw; and engaging a series of detents on a lead screw.

* * * * *